US006808329B2

(12) United States Patent
Shiraishi et al.

(10) Patent No.: US 6,808,329 B2
(45) Date of Patent: Oct. 26, 2004

(54) PAPER EJECTION APPARATUS IN A PRINT APPARATUS

(75) Inventors: Tatsuya Shiraishi, Ibaraki (JP); Yasushi Hashimoto, Ibaraki (JP); Hiroaki Yonekawa, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/233,545

(22) Filed: Sep. 4, 2002

(65) Prior Publication Data

US 2003/0063941 A1 Apr. 3, 2003

(30) Foreign Application Priority Data

Sep. 28, 2001 (JP) ..... P.2001-301394

(51) Int. Cl.[7] ..... B41J 29/16; B65H 43/04

(52) U.S. Cl. ..... 400/718; 271/215

(58) Field of Search ..... 400/718, 717, 400/679; 270/37, 58.17; 271/214, 215, 220, 280, 303; 399/204, 405

(56) References Cited

U.S. PATENT DOCUMENTS 4,022,679 A * 5/1977 Koziol et al. ..... 204/284
4,667,953 A * 5/1987 Hirakawa et al. ..... 271/280
4,993,697 A * 2/1991 Yamashita et al. ..... 270/58.17
5,074,837 A * 12/1991 Blanton et al. ..... 493/412
5,139,254 A * 8/1992 Yamashita et al. ..... 271/215
5,188,354 A * 2/1993 Emori ..... 271/217
5,350,169 A * 9/1994 Hiroi et al. ..... 271/213
6,176,480 B1 * 1/2001 Yonenuma et al. ..... 270/58.08
6,219,507 B1 * 4/2001 Yoneda et al. ..... 399/110
2002/0063380 A1 * 5/2002 Tamura et al. ..... 271/220

FOREIGN PATENT DOCUMENTS

JP 10152255 * 6/1998

* cited by examiner

*Primary Examiner*—Anjan Deb
*Assistant Examiner*—Hoai-An D. Nguyen
(74) *Attorney, Agent, or Firm*—McGinn & Gibb, PLLC

(57) ABSTRACT

A paper ejection apparatus equipped on the latter stage of an image formation apparatus in a print apparatus. The paper ejection apparatus includes a paper stack table to stack papers transported in a paper transport direction from the image formation apparatus, a table drive for moving up and down the paper stack table, a controller for controlling the table drive, top face detection means for detecting the top face position of the stacked papers, and abutment members for sliding to align the papers ejected onto the paper stack table in the paper transport direction and in a perpendicular direction to the paper transport direction. The projecting part is provided on the paper stack table.

22 Claims, 3 Drawing Sheets

PAPER EJECTION APPARATUS IN A PRINT APPARATUS

BACKGROUND OF THE INVENTION

1. Field of the Invention

This invention relates to a paper ejection apparatus equipped on the latter stage of an image formation apparatus in a print apparatus.

2. Background Art

FIGS. 4 and 5 show the configuration of a paper ejection unit in a related art.

A paper ejection unit 2 has a paper transport roller 4 for transporting paper 1 sent from an image formation apparatus 3 to the following stage, a paper stack table 6 (simply, stack table) being supported movably up and down for stacking and storing paper 1 transported from the paper transport roller 4, a slidable paper alignment member 7 being placed in parallel with the stack section paper transport direction for pressing both end parts of the paper 1, thereby aligning the paper 1, a slidable paper alignment member 8 being placed in an orthogonal direction to the stack section paper transport direction for pressing the tip of the paper 1, thereby aligning the paper 1, a rotation member 9 for pressing the rear end part of the paper 1 on the stack table 6 in a vertical direction, a comb-teeth-like paper rear end stopper 15 being fixed upright at a constant position in the proximity of the rotation member 9, a plurality of paper top face press rollers 5 placed to press the top face of the paper 1 ejected onto the stack table 6, and detection means 10 for detecting the top face of the paper stack face. Hitherto, a configuration wherein the paper 1 is stacked on the stack table 6 for storage while the stack table 6 is moved down with an increase in the stack amount of paper ejected onto the stack table 6 has been known.

This kind of paper ejection unit may be connected to the latter stage of an image formation apparatus such as a laser beam printer for use. The recent image formation apparatus enables the operator to select a double-sided print mode for recording and forming a toner image on both sides of paper, a face-up eject mode for ejecting paper with the toner image face upward, a face-down eject mode for ejecting paper with the toner image face downward, etc., as the operator desires.

As the image formation apparatus, an electrophotographic apparatus using an electrophotographic process is known. As a technique of fixing a toner image formed on paper on the paper, generally a thermal fixing roller technique is adopted in the image formation apparatus (electrophotographic apparatus). As for paper ejected through this kind of thermal fixing roller technique, the both-end edge parts of the paper parallel with the paper transport direction warp to the toner image face and tend to easily curl because of thermal shrinkage, etc., by the heating action and the component fiber direction of the paper itself. Therefore, for example, if paper is ejected in the face-up eject mode after a toner image is thermally fixed on one side of the paper, the paper easily curls upward; if paper is ejected in the face-down eject mode, the paper easily curls downward.

In the paper ejection unit in the related art, a problem remains for change in the paper stack state depending on the paper curl direction caused by the paper eject mode of the image formation apparatus. Particularly, when downward curl paper ejected in the face-down eject mode is stacked, if the paper stack amount exceeds 1,000 sheets, the top face of the stacked paper section is bent like an inverse U shape as the downward paper curls are accumulated. The stack table height is controlled based on the height position of the proximity of the bend part top face detected by the paper top face detection means. On the other hand, as downward curls accumulated, the both-end edge part vicinities of paper particularly parallel with the paper transport direction may be lowered about 5 mm to 10 mm below the bent part top face.

There is a technique wherein a slidable paper alignment member being placed in parallel with the stack section paper transport direction for pressing both end parts of paper, thereby aligning the paper presses both end parts of the paper edges parallel with the paper transport direction, thereby aligning the paper while the paper alignment member repeats sliding in an orthogonal direction to the paper transport direction. However, it occurs that an overlap between the paper alignment member and the stacked paper top part becomes extremely small or vanishes. In this case, a problem of inaccurate paper alignment on the paper stack top in the paper ejection unit occurs.

Such a phenomenon appears noticeably with downward curls hard to correct by paper's own weight.

SUMMARY OF THE INVENTION

It is therefore an object of the invention to provide a paper ejection apparatus for making it possible to reliably stack paper and provide good paper alignment on a paper stack table regardless of paper eject mode, particularly in a face-down paper eject mode.

To attain the above-mentioned object, in the invention, a projection part is provided at a position in the proximity of paper top face detection means in a paper stack direction on a paper stack table.

The projection part is positioned upstream in a paper transport direction from the center of the paper stack table and has a slope upstream in the paper transport direction.

The projection part can be attached to and detached from the paper stack table.

DETAILED DESCRIPTION OF THE PREFERRED EMBODIMENTS

Referring now to the accompanying drawings, there is shown a preferred embodiment of the invention.

Figure 3:
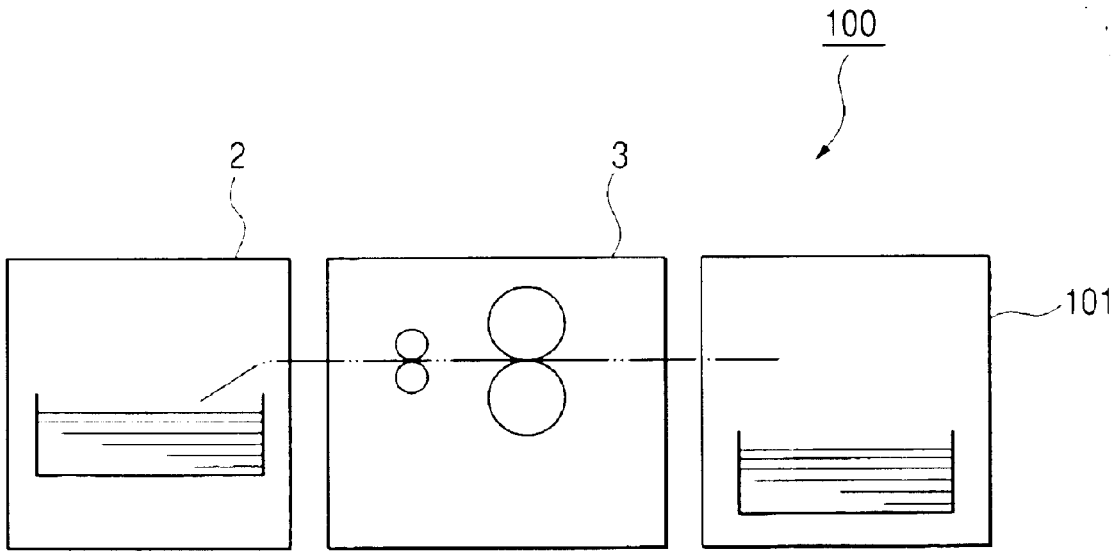
FIG. 3 is a schematic drawing of a print apparatus in the invention.
Figure 4:
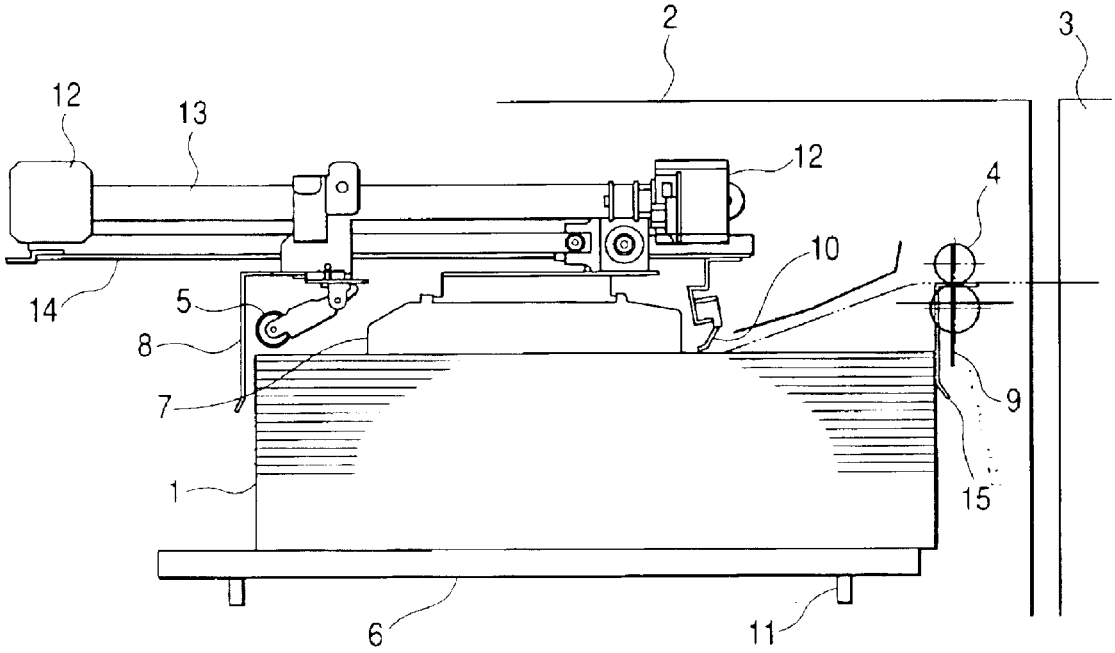
FIG. 4 is a schematic drawing of a paper ejection unit in a related art.
Figure 5:
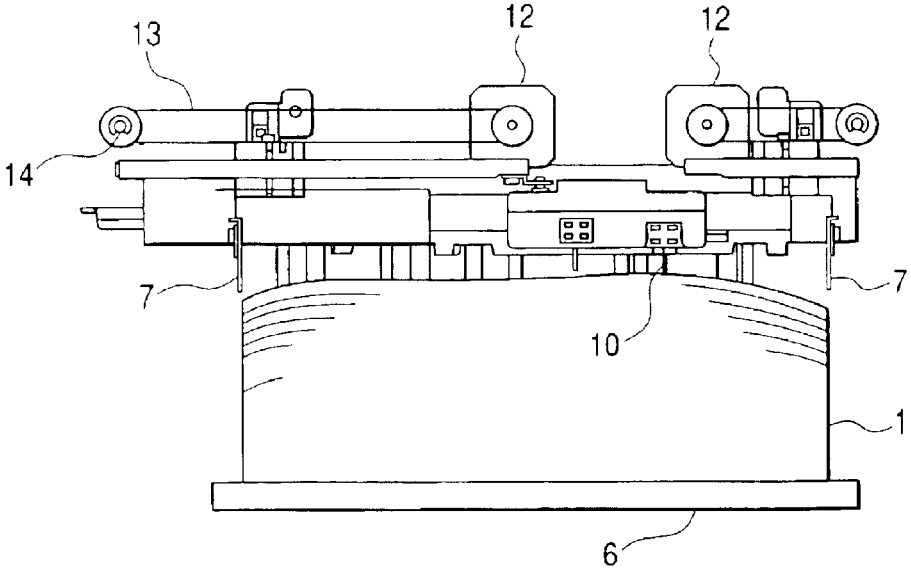
FIG. 5 is a schematic drawing as a side view of the paper ejection unit in the related art.

FIG. 3 is a schematic view of a print apparatus of an embodiment according to the invention.

As shown in FIG. 3, the print apparatus 100 includes a paper feeding apparatus 101 for feeding papers to be printed, an image formation apparatus 3, such as a copier or a laser beam printer, for forming an image onto the papers, and a paper ejection unit 2.

Figure 1:
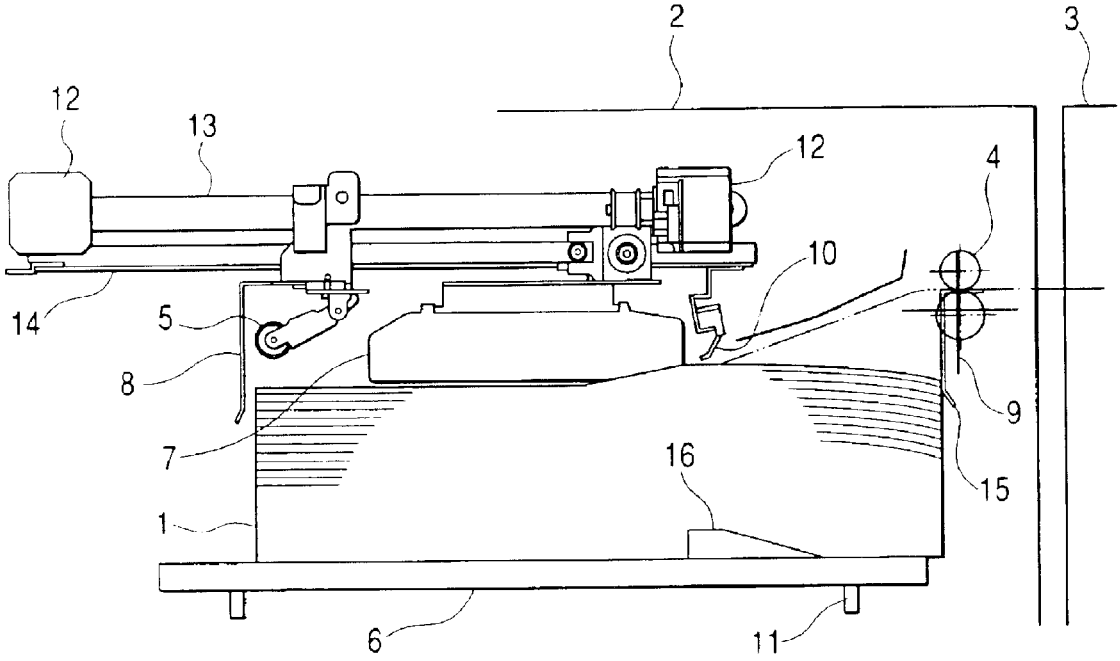
FIG. 1 is a schematic drawing of a paper ejection unit of one embodiment of the invention.
Figure 2:
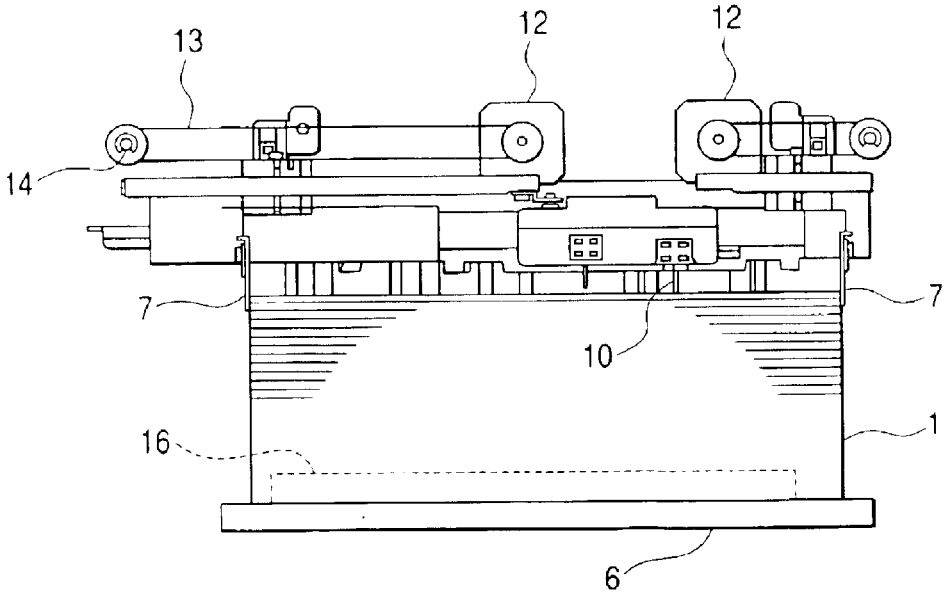
FIG. 2 is a schematic drawing as a side view of the paper ejection unit of the embodiment of the invention.

FIG. 1 is a front view to show a paper stack section of the paper ejection unit 2. FIG. 2 is a side view to show the paper stack section of the paper ejection unit 2.

As shown in FIG. 1, the paper ejection unit 2 is placed at the rear of an image formation apparatus 3 such as a copier or a laser beam printer and is made up of a paper transport roller 4 for transporting paper 1 sent from the image formation apparatus 3 to the following stage, a paper stack table 6 (simply, stack table) being supported movably up and down for stacking and storing paper 1 transported from the paper transport roller 4, a slidable paper alignment member 7 being placed in parallel with the paper transport direction in the paper stack section for repeatedly pressing both-end edge parts of the paper 1 parallel with the transport direction of the paper 1, thereby aligning the paper 1 in an orthogonal direction to the paper transport direction, a slidable paper alignment member 8 being placed in an orthogonal direction to the stack section paper transport direction for repeatedly pressing the tip of the paper 1, thereby aligning the paper 1 in the paper transport direction, a rotation member 9 for pressing the rear end part of the paper 1 on the stack table 6 in an orthogonal direction, a comb-teeth-like paper rear end stopper 15 being fixed upright at a constant position in the proximity of the rotation member 9, a plurality of paper top face press rollers 5 placed to press the top face of the paper 1 ejected onto the stack table 6, and detection means 10 for detecting the top face of the paper stack face. The stack table 6 is placed detachably on a table arm 11 that can be moved up and down. When a predetermined amount of paper is placed on the stack table 6, the entire stack table 6 can be detached from the table arm 11 and can be transported by the operator.

The paper alignment members 7 and 8 are slid matching the size of the paper 1 stacked via a power transmission belt 13 and a drive shaft 14 by power from a motor 12. The rotation member 9 is rotated via a power transmission belt (not shown) and a drive shaft 17 by power from a motor (not shown).

If the operator selects a face-down eject mode, paper is ejected so as to place the print face downward. Thus, when paper is transported into the paper ejection unit, the papers are stacked on the stack table 6 like an inverse U shape because of the downward curl. At this time, if the number of sheets of paper stacked like an inverse U shape exceeds 1,000, for example, the paper sheets are bent like a larger inverse U shape as the downward curls are accumulated. At the time, the detection means 10 for detecting the top face of the paper stack face detects the top face of the portion bent like the inverse U shape and controls the stack table 6. The both-end edge parts of paper parallel with the paper transport direction are lowered about 5 mm to 10 mm below the top face bent like the inverse U shape. Therefore, when the paper alignment member 7 aligns both end parts of paper while it repeats sliding the paper transport direction and in the orthogonal direction thereto, the overlap between the top part of the stacked paper and the paper alignment member 7 becomes extremely small or vanishes so that a paper alignment trouble on the stacked paper top in the paper ejection unit is incurred.

One embodiment of the invention is shown in FIG. 1. A projection part 16 is provided at the position of the stack table 6 where it is in the proximity of the paper top face detection means 10 in the paper stack direction (upper side). Further, the orthogonal direction to the paper transport direction is the length direction of the projection part 16 and the projection part 16 has a width almost equal to the width of the paper 1, as shown in FIG. 2.

The projection part 16 is provided with a slope upstream in the paper transport direction so that it is positioned upstream in the paper transport direction from the center of the stack table 6. Thus, occurrence of inverse U-shaped bend part of the paper rear end part caused by downward curls can be prevented more effectively.

If the operator selects a face-up eject mode so as to place the print face upward, the projection part 16 on the stack table 6 is removed, whereby occurrence of U-shaped bend can be prevented.

According to the invention, there can be provided the paper ejection unit for making it possible to reliably stack paper and provide good paper alignment on the paper stack table regardless of the paper eject mode, particularly in the face-down paper eject mode.

What is claimed is:

1. A paper ejection apparatus comprising:

a paper stack table to stack papers transported from an image formation apparatus, the papers being transported in a paper transport direction;

a table drive for moving up and down the paper stack table;

a controller for controlling the table drive;

top face detection means for detecting a top face position of a stack of papers on the paper stack table;

abutment members for sliding to align papers that are ejected onto the paper stack table in the paper transport direction and in a perpendicular direction to the paper transport direction; and a projecting part on the paper stack table, wherein the projecting part and the top face detection means are on a plane that is substantially perpendicular to the paper stack table.

2. The apparatus of claim 1, wherein said plane is substantially perpendicular to said paper transport direction.

3. The paper ejection apparatus of claim 1, wherein the projecting part is positioned upstream in the paper transport direction from the center of the paper stack table and has a slope upstream in the paper transport direction.

4. The paper ejection apparatus of claim 1, wherein the projecting part has a height of 5 to 10 mm relative to the paper stack table.

5. The paper ejection apparatus of claim 1, wherein the projecting part extends in a direction perpendicular to the paper transport direction.

6. The paper ejection apparatus of claim 1, wherein the projecting part can be attached to and detached from the paper stack table.

7. A print apparatus comprising:

an image formation apparatus;

a paper stack table for stacking papers ejected from the image forming apparatus, the papers being transported in a paper transport direction to the paper stack table;

a table drive for moving up and down a paper stack table;

a controller for controlling the table drive;

top face detection means for detecting the top face position of a stack of papers on the paper stack table;

abutment members for sliding to align papers that are ejected onto the paper stack table in the paper transport direction and in a perpendicular direction to the paper transport direction; and a projecting part on the paper stack table, wherein the projecting part and the top face detection means are on a plane that is substantially perpendicular to the paper stack table.

8. The apparatus of claim 7, wherein said plane is substantially perpendicular to said paper transport direction.

9. The print apparatus as claimed in claim 7, wherein the projecting part is positioned upstream in the paper transport direction from the center of the paper stack table and has a slope upstream in the paper transport direction.

10. The print apparatus as claimed in claim 7, wherein the projecting part has a height of 5 to 10 mm relative to the paper stack table.

11. The print apparatus as claimed in claim 7, wherein the projecting part extends in a direction perpendicular to the paper transport direction.

12. The print apparatus as claimed in claim 7, wherein the projecting part can be attached to and detached from the paper stack table.

13. A paper stacker comprising:

a paper stack table that receives papers in a paper transport direction;

a table driver that moves the paper stack table orthogonally to the paper transport direction;

a controller that controls the table driver;

a top face detector that detect a top face position of a stack of papers on the paper stack table;

abutment members that align papers received by the paper stack table in direction that is substantially parallel to the paper transport direction and in a direction that is substantially perpendicular to the paper transport direction; and a projection on the paper stack table, wherein the projection and the top face detector are on a plane that is substantially perpendicular to the paper stack table.

14. The stacker of claim 13, wherein said plane is perpendicular to said paper transport direction.

15. The stacker of claim 13, wherein the controller controls the table driver to move the paper stack table vertically based upon the position of the top face of the stack of papers.

16. The stacker of claim 13, wherein the abutment members that align the papers in substantially perpendicular to the paper transport direction extend downwardly a fixed distance.

17. The stacker of claim 13, wherein the projection is positioned upstream in the paper transport direction from the center of the paper stack table.

18. The stacker of claim 13, wherein the projection comprises a surface that slopes to the surface of the paper stack table opposite to the paper transport direction.

19. The stacker of claim 13, wherein the projection has a height of about 5 to 10 mm.

20. The stacker of claim 13, wherein the projection extends in a direction substantially perpendicular to the paper transport direction.

21. The stacker of claim 13, wherein the projection is detachably attached to the paper stack table.

22. The stacker of claim 13, wherein the abutment members are slidable in a corresponding alignment direction.

* * * * *